US008834330B1

(12) United States Patent
Morales

(10) Patent No.: US 8,834,330 B1
(45) Date of Patent: Sep. 16, 2014

(54) FOREARM EXERCISER APPARATUS

(76) Inventor: Jose E. Morales, Rockford, IL (US)

( * ) Notice: Subject to any disclaimer, the term of this patent is extended or adjusted under 35 U.S.C. 154(b) by 210 days.

(21) Appl. No.: 13/486,859

(22) Filed: Jun. 1, 2012

(51) Int. Cl.
*A63B 21/072* (2006.01)
*A63B 21/075* (2006.01)

(52) U.S. Cl.
USPC ..... 482/107

(58) Field of Classification Search
CPC ..... A63B 21/00; A63B 21/00061; A63B 21/00058; A63B 21/00065; A63B 21/00079; A63B 21/00116; A63B 21/0012; A63B 21/06; A63B 21/062; A63B 21/14; A63B 21/1453; A63B 21/1465; A63B 21/1469; A63B 21/148; A63B 21/1488; A63B 21/1492; A63B 21/15; A63B 21/16
USPC ..... 482/44–50, 92–94, 98–102, 106–107, 482/139, 148, 905, 907
See application file for complete search history.

(56) References Cited

U.S. PATENT DOCUMENTS

| | | | | | |
|---|---|---|---|---|---|
| 85,996 | A * | 1/1869 | Butler | 482/94 |
| 323,792 | A * | 8/1885 | Coop et al. | 482/102 |
| 2,632,645 | A * | 3/1953 | Barkschat | 482/38 |
| 3,019,019 | A * | 1/1962 | Forte | 482/94 |
| 3,290,044 | A * | 12/1966 | Krodsen et al. | 482/94 |
| 3,294,399 | A * | 12/1966 | Cugliari | 482/94 |
| 3,861,675 | A * | 1/1975 | Hopper | 482/55 |
| 4,134,584 | A * | 1/1979 | Rosenbusch | 482/93 |
| 4,431,181 | A * | 2/1984 | Baswell | 482/38 |
| 4,577,861 | A * | 3/1986 | Bangerter et al. | 482/79 |
| 4,624,457 | A * | 11/1986 | Silberman et al. | 482/98 |
| 4,741,528 | A * | 5/1988 | Church | 482/63 |
| 4,811,944 | A | 3/1989 | Hoff | |
| 4,884,800 | A * | 12/1989 | Duke | 482/73 |
| 5,496,240 | A * | 3/1996 | Damm | 482/93 |
| 5,542,895 | A * | 8/1996 | Colbo, Jr. | 482/98 |
| 5,810,697 | A * | 9/1998 | Joiner | 482/68 |
| 5,827,157 | A * | 10/1998 | Lee | 482/93 |
| 7,141,002 | B2 * | 11/2006 | Connelly | 482/50 |
| 7,922,635 | B2 * | 4/2011 | Lull et al. | 482/142 |
| 8,591,384 | B2 * | 11/2013 | Marji | 482/50 |
| 2006/0019803 | A1 * | 1/2006 | Giaquinta et al. | 482/83 |
| 2007/0142189 | A1 * | 6/2007 | Yeh et al. | 482/112 |
| 2007/0142190 | A1 * | 6/2007 | Yeh et al. | 482/112 |
| 2007/0249472 | A1 * | 10/2007 | Frei | 482/66 |
| 2013/0337983 | A1 * | 12/2013 | McTavish, Mark | 482/139 |

* cited by examiner

*Primary Examiner* — Justine Yu
*Assistant Examiner* — Garrett Atkinson
(74) *Attorney, Agent, or Firm* — Crossley Patent Law; Micah C. Gunn

(57) ABSTRACT

A forearm exerciser apparatus that includes a box-shaped member having a pulley assembly disposed thereupon, said pulley assembly in operational communication with a bottom pad suspended within said box-shaped member by means of a cable, said bottom pad configured to receive extant weights additional thereto, wherein said bottom pad is liftable when the pulley assembly is moved between a first position and a second position, whereby the flexor and extensor muscles used to open and close a hand are strengthenable thereby.

5 Claims, 4 Drawing Sheets

FOREARM EXERCISER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of forearm exerciser apparatuses are known in the prior art. However, what is needed is a forearm exerciser apparatus that includes a box-shaped member having a pulley assembly disposed thereupon, the pulley assembly in operational communication with a bottom pad suspended within the box-shaped member by means of a cable, the bottom pad configured to receive extant weights additional thereto, wherein the bottom pad is liftable when the pulley assembly is moved between a first position and a second position, whereby the flexor and extensor muscles used to open and close a hand are strengthenable thereby.

FIELD OF THE INVENTION

The present invention relates to a forearm exerciser apparatus, and more particularly, to a forearm exerciser apparatus that includes a box-shaped member having a pulley assembly disposed thereupon, said pulley assembly in operational communication with a bottom pad suspended within said box-shaped member by means of a cable, said bottom pad configured to receive extant weights additional thereto, wherein said bottom pad is liftable when the pulley assembly is moved between a first position and a second position, whereby the flexor and extensor muscles used to open and close a hand are strengthenable thereby.

SUMMARY OF THE INVENTION

The general purpose of the forearm exerciser apparatus, described subsequently in greater detail, is to provide a forearm exerciser apparatus which has many novel features that result in a forearm exerciser apparatus which is not anticipated, rendered obvious, suggested, or even implied by prior art, either alone or in combination thereof.

Many exercise machines are seen in the prior art. However, what is needed is a forearm exerciser apparatus that includes a box-shaped member having a pulley assembly disposed thereupon, the pulley assembly in operational communication with a bottom pad suspended within the box-shaped member by means of a cable, the bottom pad configured to receive extant weights additional thereto. The bottom pad is liftable when the pulley assembly is moved between a first position and a second position, whereby the flexor and extensor muscles used to open and close a hand are strengthenable thereby.

The present invention, therefore, includes a box-shaped member having a top plate, a bottom plate, a pair of side walls vertically disposed between the top plate and the bottom plate, and a rear wall disposed between each of the pair of side walls and the top plate and the bottom plate. The box-shaped member therefore includes an interior space defined between said pair of side walls, said rear wall, and said top and bottom plate.

The pulley assembly is centrally disposed atop the top plate, and includes a vertical member and a pivot member pivotally attached to the vertical member. The pivot member is in operational communication with the cable, said cable disposed through the vertical member, through the top plate, and vertically within the box-shaped member. The bottom pad is securely connected to the cable, and the bottom pad rests atop the bottom plate of the box-shaped member when the pulley assembly is moved to the first position. When the pulley assembly is moved to the second position, the bottom pad is raised from the bottom plate by means of the cable lifting upward, rotationally engaged by means of the pivot member of the pulley assembly.

The pulley assembly is configured to be usable with a hand of a person using the device. The pivot member is squeezed toward the vertical member by the action of a hand closing. A first grip member is disposed upon the vertical member and a second grip member is disposed on the pivot member to conform said pivot member and vertical member ergonomically to the grasp of person using the device.

For comfort and added stability when using the device, a pair of handles is vertically disposed atop the top plate of the box-shaped member on either side of the pulley assembly, each of said pair of handles configured to enable a person using the device to hold one of said pair of handles with one hand while said person's other hand is used to squeeze the pulley assembly between the first position and the second position.

A plurality of weights is additional to the bottom pad. Each of said plurality of weights is configured to slidingly engage around a vertical shaft centrally disposed upwardly from the bottom pad, said vertical shaft surrounding the cable within the box-shaped member interior space up to a specific distance from the top plate. Each of the plurality of weights has a radial aperture disposed along a radius of said weight. The radial aperture is used to position the weight over the vertical shaft wherein an open hole centrally disposed upon said weight overlies the vertical shaft. The open hole is configured to slidingly receive the vertical shaft therein. Therefore a person fits a weight to the bottom pad by first sliding the cable through the radial aperture to position the open hole over the vertical shaft, and then lowers the weight down onto the shaft, until the weight comes to rest atop the bottom pad or a previously fitted weight. Because the radial aperture is too narrow to enable the vertical shaft to pass through, each weight fitted to the vertical shaft must be first raised up above the vertical shaft before the cable will pass through the radial aperture and the weight removed.

For transport of the device a handle member is pivotally attached to the rear wall. The handle member is configured to be moveable between an upward position and a stowed position. When the handle member is in the stowed position, said handle member is disposed parallel and in contact with the rear wall. When moved to the upward position the handle pivots through approximately 180 degrees from the stowed position to extend upwardly from the box-shaped member. The handle member includes a U-shaped member having a pair of prongs and a cross-piece. Each of the pair of prongs is pivotally attached to the rear wall proximal to the top plate. An outer tube is centrally disposed upon the cross-piece in a plane congruent with the plane of the U-shaped member. An inner tube is slidingly extensible from within the outer tube, said inner tube releasably securable at particular extensions from within said outer tube by means of each of a plurality of ball detents releasably engaging the inner tube with the outer tube. A crossbar is disposed perpendicularly upon the inner tube, said crossbar useable to grasp the handle member and direct the box-shaped member, as desired, when moving the box-shaped member as will be described subsequently.

To move the box-shaped member, even with the plurality of weights added to the bottom pad, the box-shaped member is first tilted rearwards onto a pair of caster wheels disposed upon the rear wall proximal to the bottom plate. The pair of caster wheels volubly support the box-shaped member in an angular situation, and the forearm exerciser apparatus is thereby moveable, as desired, and directional by means of the handle member, when said handle member is moved to the upward position.

As should be readily apparent, therefore, a person can strengthen his forearm and hand by means of the present device, and can adapt the amount of force required to move the pivot member between the first position and the second position by adding and alternately subtracting additional weights to and from the bottom pad, as desired.

Thus has been broadly outlined the more important features of the present forearm exerciser apparatus so that the detailed description thereof that follows may be better understood and in order that the present contribution to the art may be better appreciated.

Objects of the present forearm exerciser apparatus, along with various novel features that characterize the invention are particularly pointed out in the claims forming a part of this disclosure. For better understanding of the forearm exerciser apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
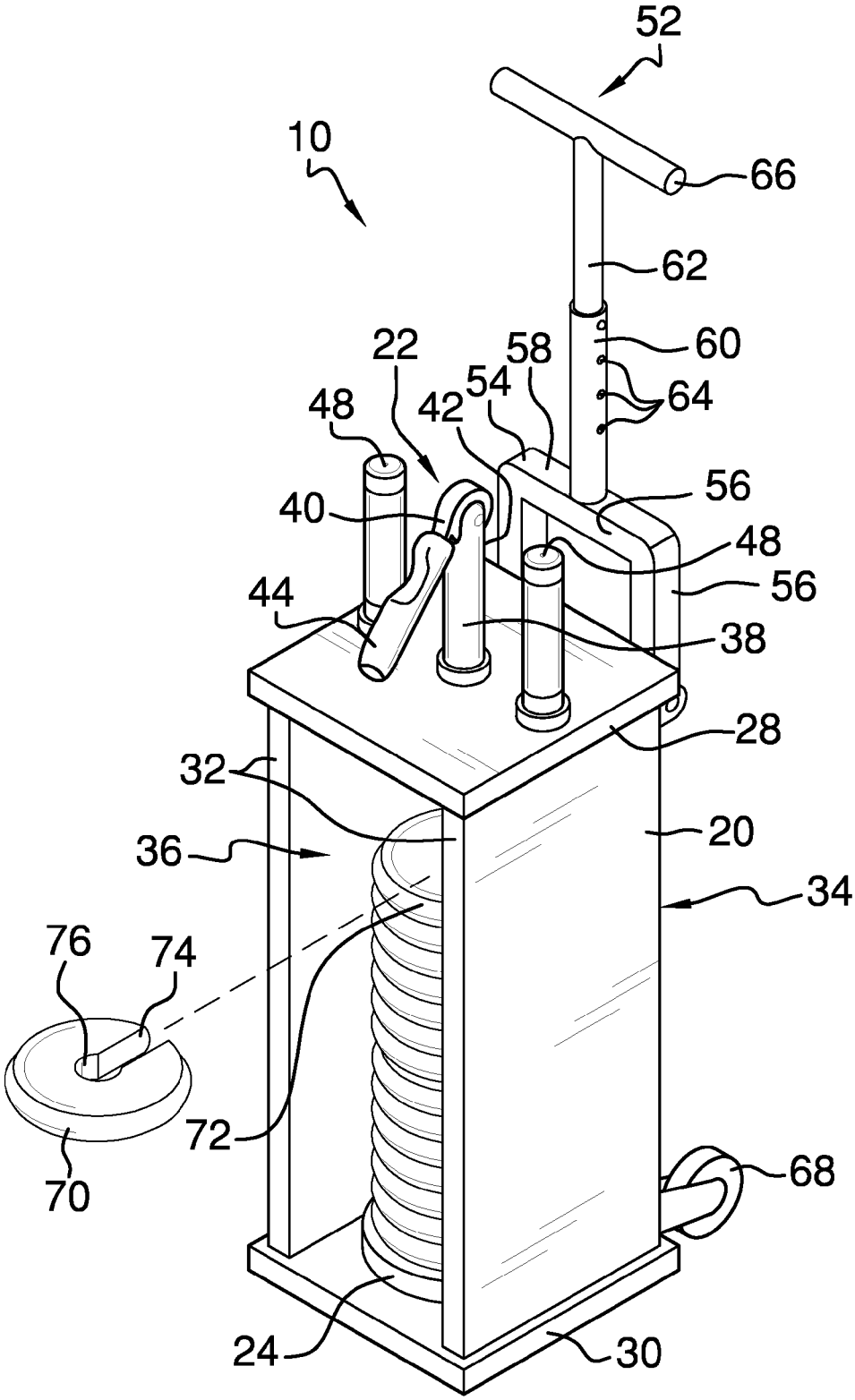
FIG. 1 is an isometric view.
Figure 2:
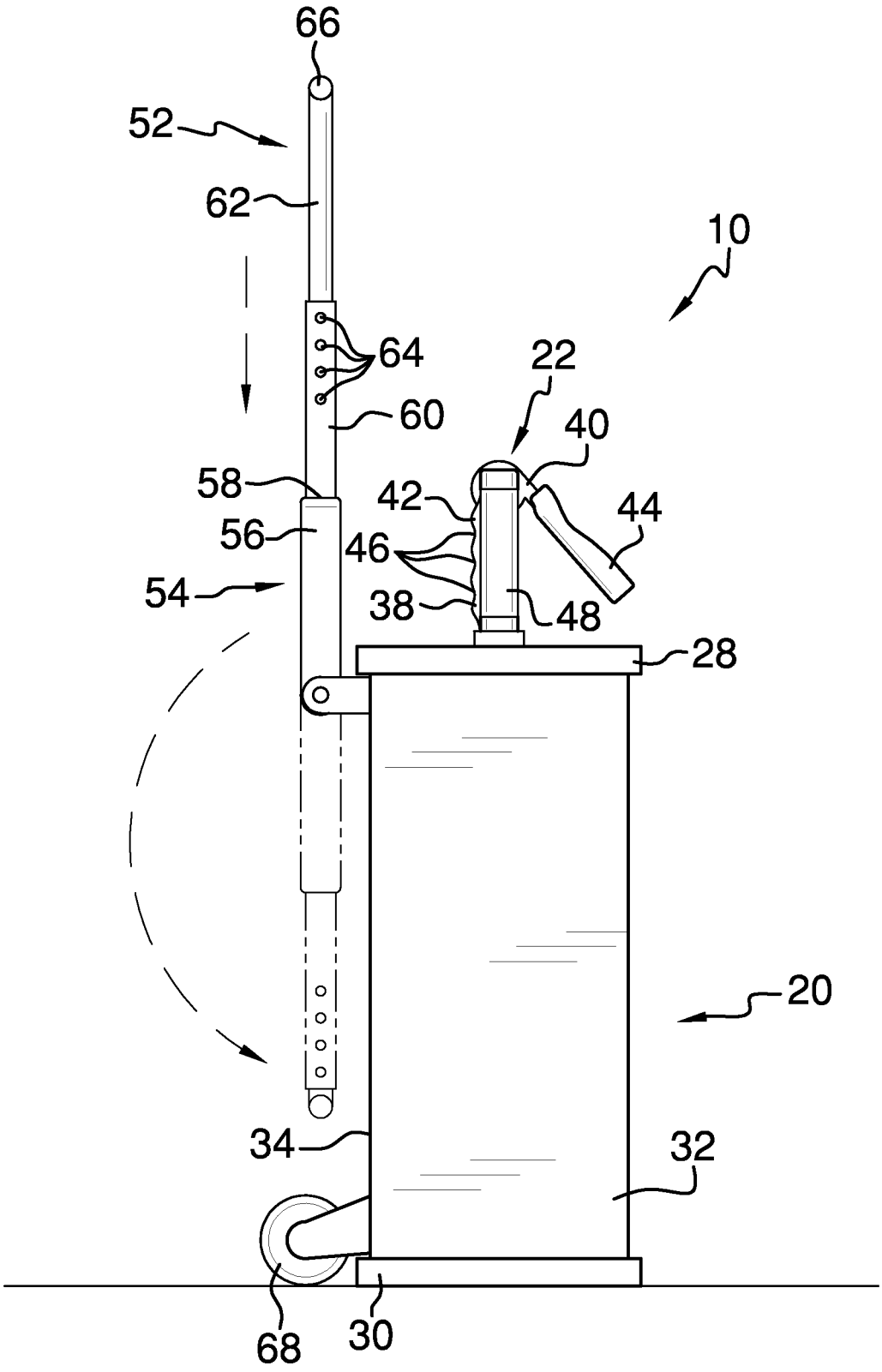
FIG. 2 is a side view.
Figure 3:
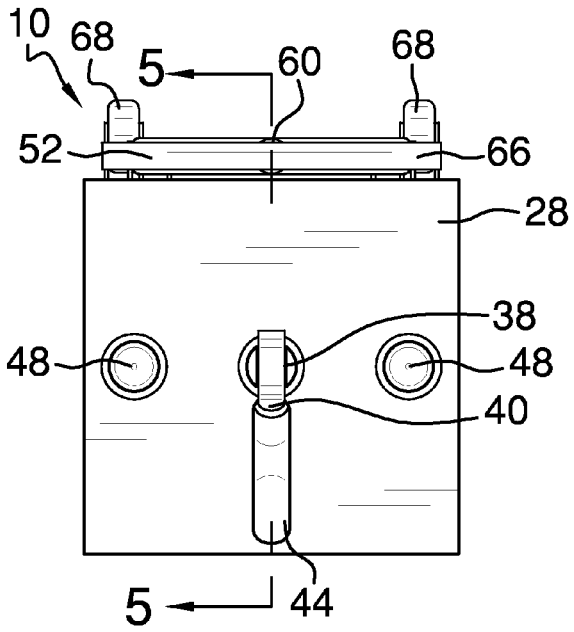
FIG. 3 is a top view.
Figure 4:
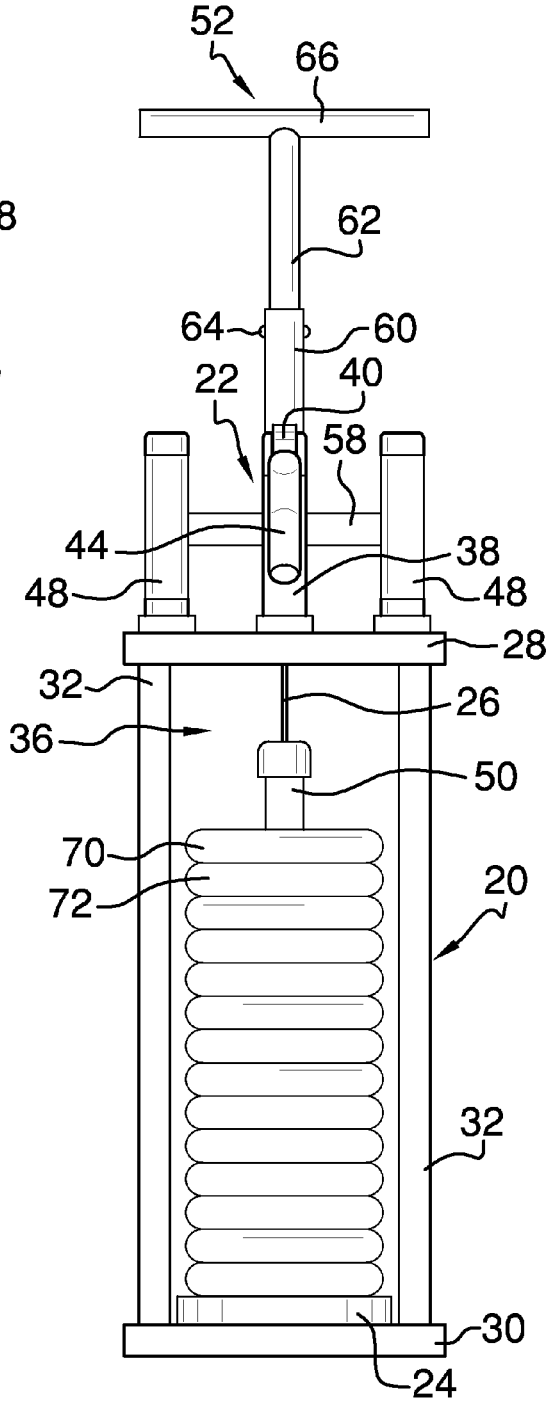
FIG. 4 is a front view.
Figure 5:
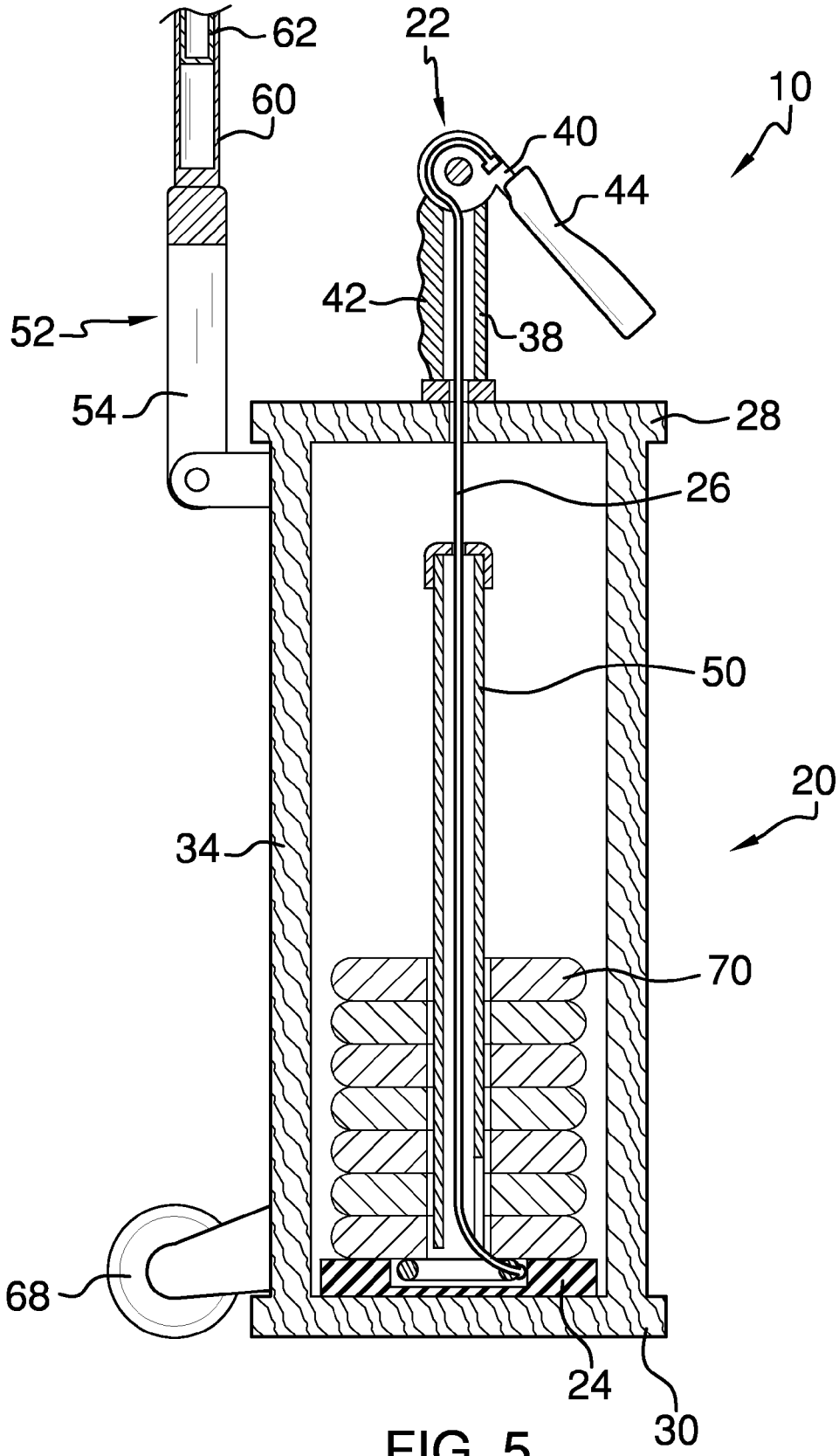
FIG. 5 is a cross-section view taken along the line 5-5 of FIG. 3.

With reference now to the drawings, and in particular FIGS. 1 through 5 thereof, example of the instant forearm exerciser apparatus employing the principles and concepts of the present forearm exerciser apparatus and generally designated by the reference number 10 will be described.

Referring to FIGS. 1 through 5 a preferred embodiment of the present forearm exerciser apparatus 10 is illustrated.

The present forearm exerciser 10 has been devised to enable a person (not shown) to increase the strength of their hands and forearms, as desired, by squeezing a hand closed around the device 10 wherein a plurality of muscles in the hand and forearm are exercised. Such muscles may include, and are not necessarily limited to, the flexor digitorum superfiicialis, the pronator quadratus, the flexor carpi ulnaris, the palmaris longus, the flexor carpi radialis, among other flexor and extensor muscles usable in flexing and extending the hand.

The forearm exerciser apparatus 10 includes a box-shaped member 20 having a pulley assembly 22 disposed thereupon. The pulley assembly 22 is in operational communication with a bottom pad 24 by means of a cable 26 suspended through the box-shaped member 20. When the pulley assembly 22 is operated, as will be subsequently described, the bottom pad 24 is raised and any extent weights 70 added to the bottom pad 24 is likewise lifted.

The box-shaped member 20 includes a top plate 28, a bottom plate 30, a pair of side walls 32 vertically disposed between the top plate 28 and the bottom plate 30, and a rear wall 34 vertically disposed between the top plate 28 and the bottom plate 30. An interior space 36 is thereby enclosed by each of the pair of side walls 32, the rear wall 34, the top plate 28, and the bottom plate 30. A door (not shown) may be hingedly attached to enclose the interior space 36 from the front side, or, as depicted herein, the front side may be left open whereby the interior space 36 is accessible for the addition of extant weights 70 to the bottom pad 24 as desired.

The pulley assembly 22 is centrally disposed atop the top plate 28, said pulley assembly 22 including a vertical member 38 and a pivot member 40 pivotally disposed atop the vertical member 38. The pivot member 40 is moveable thereat between a first position and a second position. For increased comfort when using the present forearm exerciser apparatus 10, a first grip member 42 is disposed around the vertical member 38 and a second grip member 44 is disposed upon the pivot member 40. The first grip member 42 has a plurality of indentations 46 thereupon, said plurality of indentations 46 configured to ergonomically accommodate each of a plurality of fingers of a person using the device 10, and the second grip member 44 is configured to ergonomically receive a palm of a person using the device 10.

To assist in exercising one hand, a pair of handles 48 is vertically disposed atop the top plate 28, each of said pair of handles 48 disposed on either side of the vertical member 38 of the pulley assembly 22. Thusly positioned, a person using the present forearm exerciser apparatus 10 may grasp one of the pair of handles 48 (using the hand not currently undergoing exercise with the pulley assembly 22) for greater stability and comfort.

Thusly, a person squeezes the pivot member 40 toward the vertical member 38 by the action of closing a hand around said pivot member 40 and said vertical member 38. The pivot member 40 moves to the second position when most proximal to the vertical member 38. When moved to the second position, the pivot member 40 pulls the cable 26 and the bottom pad 24 is raised. Adding extant weights 70 to the bottom pad 24 increases the weight resisting the movement of the pivot member 40 to the second position, and thusly an equivalent amount of force is subsequently required to move the pivot member 40 to the second position, said amount of force directly proportional to the amount of weight added to the bottom pad 24. Thusly, a person may increase the force required to raise the bottom pad 24 by adding additional weights to the bottom pad 24, as desired, and strengthen his forearms and hands thereby.

The cable 26 is suspended from the pivot member 40 through the vertical member 38 and the top plate 28 into the box-shaped member 20 interior space 36. The cable 26 reaches to, or proximal to, the bottom of the interior space 36 of the box-shaped member 20 and is securely attached to the bottom pad 24. The bottom pad 24 is therefore suspended from the pulley assembly 22 by means of the cable 26, said bottom pad 24 resting atop the bottom plate 30 of the box-shaped member 20 when the pivot member 40 is in the first position.

A vertical shaft 50 is centrally disposed upon the bottom pad 24, said shaft 50 disposed upwardly surrounding the cable 26 up to a specific height from the top plate 28. The vertical shaft 50 is not disposed to surround the entire length of cable 26 visible within the interior space 36 of the box-shaped member 20 for at least two reasons. Firstly, because the vertical shaft 50 is configured not to touch the top plate 28 of the box-shaped member 20 when the pivot member 40 is moved to the second position and the bottom pad 24 and the vertical shaft 50 are raised by means of the cable 26, and secondly, because the extant weights 70 are configured to slidingly engage with the vertical shaft 50 to securely engage said weights 70 atop the bottom pad 24.

To add a weight 70, therefore, a person simply places the weight 70 around the cable 26 proximal to the top plate 28 by means of a radial aperture 74 disposed along a radius of the weight 70. The center of the weight 70 has an open hole 76 configured to slidingly receive the shaft 50 therethrough. The weight 70 is then slid down over the shaft 50 until it contacts either the bottom pad 24 or a previously fitted weight 72. Because the radial aperture 74 of the weight 70 is less wide than the width of the shaft 50, the weight 70 is not removable from the vertical shaft 50 unless said weight 70 is raised up above the vertical shaft 50, and thereafter disengaged by removing the weight 70 by passing the cable 26 through the radial aperture 74.

An extensible handle member 52 is pivotally disposed upon the rear wall 34, said handle member 52 disposed proximal the top plate 28. The handle member 52 is moveable between an upward position and a stowed position. The handle member 52 includes a U-shaped member 54 having a pair of prongs 56 and a cross-piece 58. Each of said pair of prongs 56 is pivotally attached to the rear wall 34 proximal the top plate 28. An outer tube 60 is centrally disposed upon the cross-piece 58 of the U-shaped member 54, said outer tube 60 disposed in a plane congruent with the U-shaped member 54. An inner tube 62 is slidingly disposed within the outer tube 60, said inner tube 62 releasably securable at given heights along the outer tube 60 by means of each of a plurality of ball detents 64. A generally cylindrical crossbar 66 is disposed endwise perpendicularly upon the inner tube 62, said crossbar 62 graspable when using the handle member 52. The inner tube 62 is readily extensible from the outer tube 60 and releasably securable at a given extension by means of each of the plurality of ball detents 64. When moved to the upward position, the handle is pivoted by means of the U-shaped member 54, and raised upward to extend above the top plate 28 of the box-shaped member 20.

Conversely, the inner tube 62 readily stows within the outer tube 60, sliding within the outer tube 60 until the crossbar 66 abuts the outer tube 60, and the handle member 52 is moveable to the stowed position to rest against the rear wall 34. When the handle member 52 is moved to the stowed position, the handle member 52 is disposed adjacent to and parallel with the rear wall 34 of the box-shaped member 20. The handle member 52 is therefore conveniently positionable out of the way, contained up against the box-shaped member 20 to not protrude therefrom until desired for use.

To move the forearm exerciser apparatus 10 a pair of caster wheels 68 is disposed upon the rear wall 34 proximal to the bottom plate 30. The pair of caster wheels 68 is disposed to contact the ground for transport of the forearm exerciser apparatus 10 when the box-shaped member 20 is tilted thereupon. The forearm exerciser apparatus 10 is therefore moveable upon said pair of caster wheels 68 and directable by means of the handle member 52, when said handle member 52 is moved to the upward position, even with a plurality of extent weights remaining upon the bottom pad 24. The weight of the apparatus 10, and any additional weights added thereto, is easily distributed by means of the pair of caster wheels 68 and the apparatus 10 is moveable in like manner as a dolly cart, for example.

Therefore, as should be readily appreciated, the bottom pad 24 is lifted by action of the pulley assembly 22 when the pivot member 40 is moved to the second position and a plurality of extant weights 70 is additional to the bottom pad 24 whereby squeezing the pivot member 40 toward the vertical member 38 alternately raises and lowers the bottom pad 24, and any additional weights added thereto, and a person using the device may exercise each forearm and hand by alternately moving the pivot member 40 between the first position and the second position with first one hand and then the other hand adding or subtracting additional weights from the bottom pad 24, as desired.

What is claimed is:

1. A forearm exerciser apparatus comprising:

a box-shaped member having a top plate;

a pulley assembly disposed atop the box-shaped member, said pulley assembly comprising:

a vertical member;

a pivot member pivotally disposed atop the vertical member moveable between a first position and a second position;

a cable suspended from the pivot member through the vertical member, said cable reaching to a bottom of an interior space of the box-shaped member;

a bottom pad suspended from the pulley assembly by means of the cable, said bottom pad resting at the bottom of the interior space of the box-shaped member when the pivot member is in the first position;

a vertical shaft centrally disposed upon the bottom pad, said shaft disposed surrounding the cable up to a specific height from the top of the box-shaped member;

wherein the bottom pad is lifted by action of the pulley assembly when the pivot member is moved to the second position and a plurality of extant weights is additional to the bottom pad whereby squeezing the pivot member toward the vertical member alternately raises and lowers the bottom pad and any additional weights added thereto;

a pair of handles vertically disposed atop the tog plate, each handle disposed on one side of the vertical member of the pulley assembly;

a handle member pivotally disposed upon the box-shaped member;

a pair of caster wheels disposed upon the box-shaped member, the caster wheels configured to contact the ground for transport of the forearm exerciser apparatus when the box-shaped member is tilted thereupon;

wherein the box-shaped member further comprises:

a bottom plate;

a support structure vertically disposed between the tog plate and the bottom plate;

an interior space enclosed by each of a pair of side walls, a rear wall, the top plate, and the bottom plate;

wherein the bottom pad rests atop the bottom plate when the pivot member is moved to the first position and the specific height of the vertical shaft is a specific distance from the top plate wherein the cable is moveable to raise the bottom pad and any weights additional thereto without the vertical shaft contacting the tog plate;

wherein the support structure comprises the pair of side walls and the rear wall vertically disposed between the top plate and the bottom plate;

wherein the pulley assembly further comprises:

a first grip member disposed around the vertical member, said first grip member having a plurality of indentations thereupon, said plurality of indentations configured to ergonomically accommodate each of a plurality of fingers of a person using the device;

a second grip member disposed upon the pivot member, said second grip member configured to ergonomically receive a palm of a person using the device;

wherein squeezing the second grip member toward the first grip member moves the pulley assembly from first position to the second position whereby the bottom pad, and any weights added thereto, is lifted.

2. The forearm exerciser apparatus of claim 1 further comprising:

wherein the handle member is extensible and is pivotally disposed upon the rear wall of the box-shaped member proximal the top plate, the handle member moveable between an upward position and a stowed position;

a plurality of ball detents disposed upon the handle member;

wherein the pair of caster wheels is disposed upon the rear wall of the box-shaped proximal to the bottom plate;

wherein each of the plurality of ball detents releasably engages the handle member at a desired extension, whereby the handle is moveable to the upward position and the box-shaped member tilted onto each of the pair of caster wheels and the forearm exerciser apparatus moveable thereupon.

3. The forearm exerciser apparatus of claim 2 wherein the handle member further comprises:

a U-shaped member having a pair of prongs and a cross-piece, each of said pair of prongs pivotally attached to the rear wall proximal the top plate;

an outer tube centrally disposed upon the cross-piece, said outer tube disposed in a plane congruent with the U-shaped member;

an inner tube slidingly disposed within the outer tube, said inner tube releasably securable at given heights along the outer tube by means of each of the plurality of ball detents;

a crossbar disposed endwise perpendicularly upon the inner tube;

wherein the inner tube stows within the outer tube and the crossbar rests atop the outer tube whereby the handle member rests against the rear wall when moved to the stowed position.

4. A forearm exerciser apparatus comprising:

a box-shaped member comprising:

a top plate;

a bottom plate;

a pair of side walls vertically disposed between the top plate and the bottom plate;

a rear wall vertically disposed between the top plate and the bottom plate;

an interior space enclosed by each of the pair of side walls, the rear wall, the top plate, and the bottom plate;

a pulley assembly disposed atop the top plate, said pulley assembly comprising:

a vertical member;

a pivot member pivotally disposed atop the vertical member moveable between a first position and a second position;

a first grip member disposed around the vertical member, said first grip member having a plurality of indentations thereupon, said plurality of indentations configured to ergonomically accommodate each of a plurality of fingers of a person using the device;

a second grip member disposed upon the pivot member, said second grip member configured to ergonomically receive a palm of a person using the device;

a pair of handles vertically disposed atop the top plate, each of said pair of handles disposed on either side of the vertical member of the pulley assembly;

a cable suspended from the pivot member through the vertical member, said cable reaching to a bottom of the interior space of the box-shaped member;

a bottom pad suspended from the pulley assembly by means of the cable, said bottom pad resting atop the bottom plate of the box-shaped member when the pivot member is in the first position;

a vertical shaft centrally disposed upon the bottom pad, said shaft disposed upwardly therefrom surrounding the cable to a specific height from the top plate;

an extensible handle member pivotally disposed upon the rear wall, said handle member disposed proximal the top plate, said handle member moveable between an upward position and a stowed position;

a pair of caster wheels disposed upon the rear wall proximal to the bottom plate, said caster wheels disposed to contact the ground for transport of the forearm exerciser apparatus when the box-shaped member is tilted thereupon;

wherein the bottom pad is lifted by action of the pulley assembly when the pivot member is moved to the second position and a plurality of extant weights is additional to the bottom pad whereby squeezing the pivot member toward the vertical member alternately raises and lowers the bottom pad, and any additional weights added thereto.

5. The forearm exerciser apparatus of claim 4 wherein the handle member further comprises:

a U-shaped member having a pair of prongs and a cross-piece, each of said pair of prongs pivotally attached to the rear wall proximal the top plate;

an outer tube centrally disposed upon the cross-piece, said outer tube disposed in a plane congruent with the U-shaped member;

an inner tube slidingly disposed within the outer tube, said inner tube releasably securable at given heights along the outer tube by means of each of a plurality of ball detents;

a crossbar disposed endwise perpendicularly upon the inner tube;

wherein the inner tube stows within the outer tube and the crossbar rests atop the outer tube and the handle member rests against the rear wall when moved to the stowed position;

wherein handle member pivots to the upward position and the inner tube is releasably securable at given heights slidably extensible from within the outer tube by means of the plurality of ball detents; and whereby the forearm exerciser apparatus is moveable upon the pair of caster wheels and directable by means of the handle member.

* * * * *